United States Patent [19]

Rosman et al.

[11] 4,326,582

[45] Apr. 27, 1982

[54] SINGLE ELEMENT TUBE ROW HEAT EXCHANGER

[75] Inventors: Irwin E. Rosman, Woodland Hills; William R. Wagner, Los Angeles, both of Calif.

[73] Assignee: Rockwell International Corporation, El Segundo, Calif.

[21] Appl. No.: 78,125

[22] Filed: Sep. 24, 1979

[51] Int. Cl.[3] ..... F28D 7/10; F28F 9/26

[52] U.S. Cl. ..... 165/83; 165/143

[58] Field of Search ..... 165/143, 154, 156, 178, 165/83, 141, 173, 175

[56] References Cited

U.S. PATENT DOCUMENTS

| | | | |
|---|---|---|---|
| 937,344 | 10/1909 | Walter | 165/143 |
| 1,805,917 | 5/1931 | Lysholm et al. | 165/175 |
| 1,890,185 | 12/1932 | Lucke | 165/175 X |
| 2,633,338 | 3/1953 | Hiersch | 165/143 |
| 2,804,283 | 8/1957 | Ruszkowski | 165/143 |
| 2,858,677 | 11/1958 | Stone | 165/143 |
| 3,151,672 | 10/1964 | Edmund | 165/143 |
| 3,249,153 | 5/1966 | Holland | 165/143 |
| 3,262,489 | 7/1966 | Fritzberg | 165/175 X |
| 3,275,070 | 9/1966 | Beatenbough et al. | 165/175 X |
| 3,705,622 | 12/1972 | Schwarz | 165/143 |
| 4,130,398 | 12/1978 | Knulle et al. | 165/143 X |
| 4,168,744 | 9/1979 | Knülle et al. | 165/142 |
| 4,210,199 | 7/1980 | Doucette et al. | 165/143 |

FOREIGN PATENT DOCUMENTS

| | | | |
|---|---|---|---|
| 2121473 | 12/1971 | Fed. Rep. of Germany | 165/143 |
| 2357992 | 5/1975 | Fed. Rep. of Germany | 165/173 |
| 77985 | 11/1918 | Switzerland | 165/143 |
| 339754 | 6/1972 | U.S.S.R. | 165/141 |

*Primary Examiner*—Sheldon J. Richter

*Attorney, Agent, or Firm*—H. F. Hamann; Harry B. Field

[57] ABSTRACT

A tube-in-tube shelless heat exchanger having the capability of being modularized comprises a plurality of single element tube rows 18 in combination with header means 26. The single element tube row 18 comprises a plurality of inner 12 and outer 14 concentric tube pairs for carrying a first and a second heat transfer fluid, forward and aft tube sheets 20, and flexible arcuate manifold means 16 for outer tubes 14.

10 Claims, 13 Drawing Figures

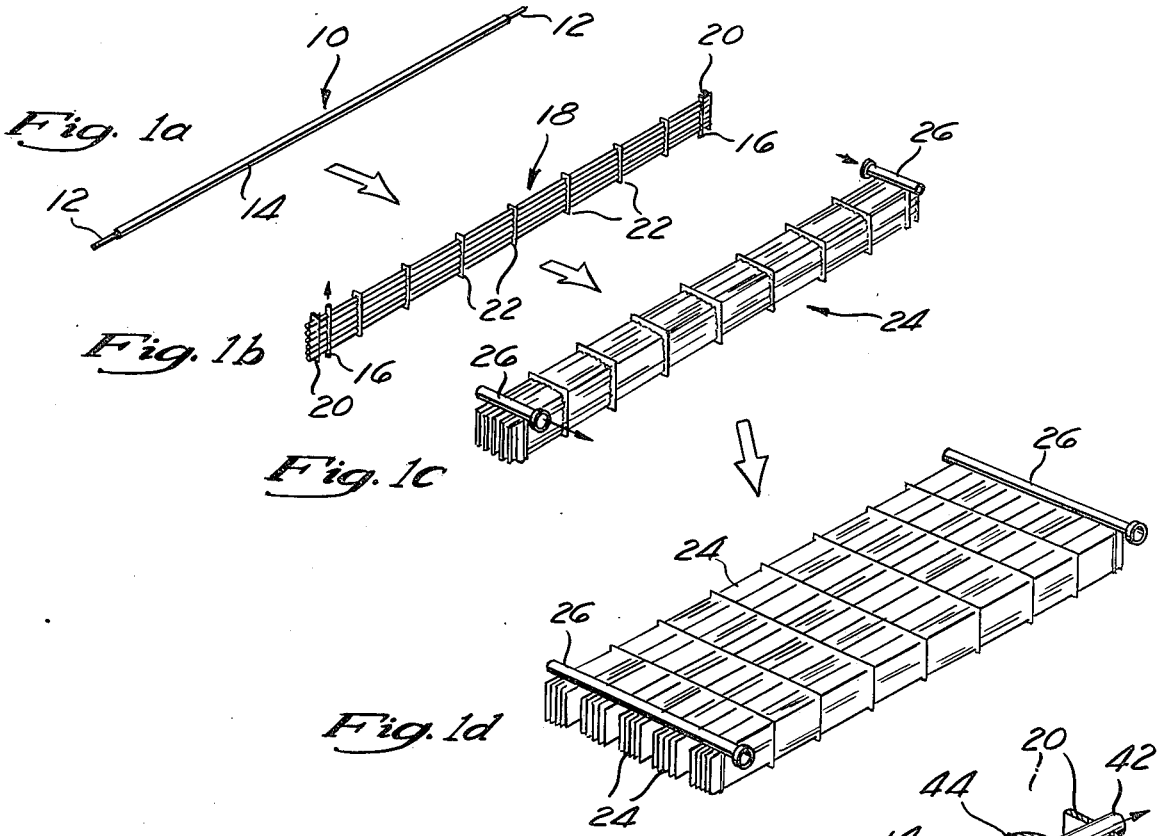
Fig. 1a
Fig. 1b
Fig. 1c
Fig. 1d
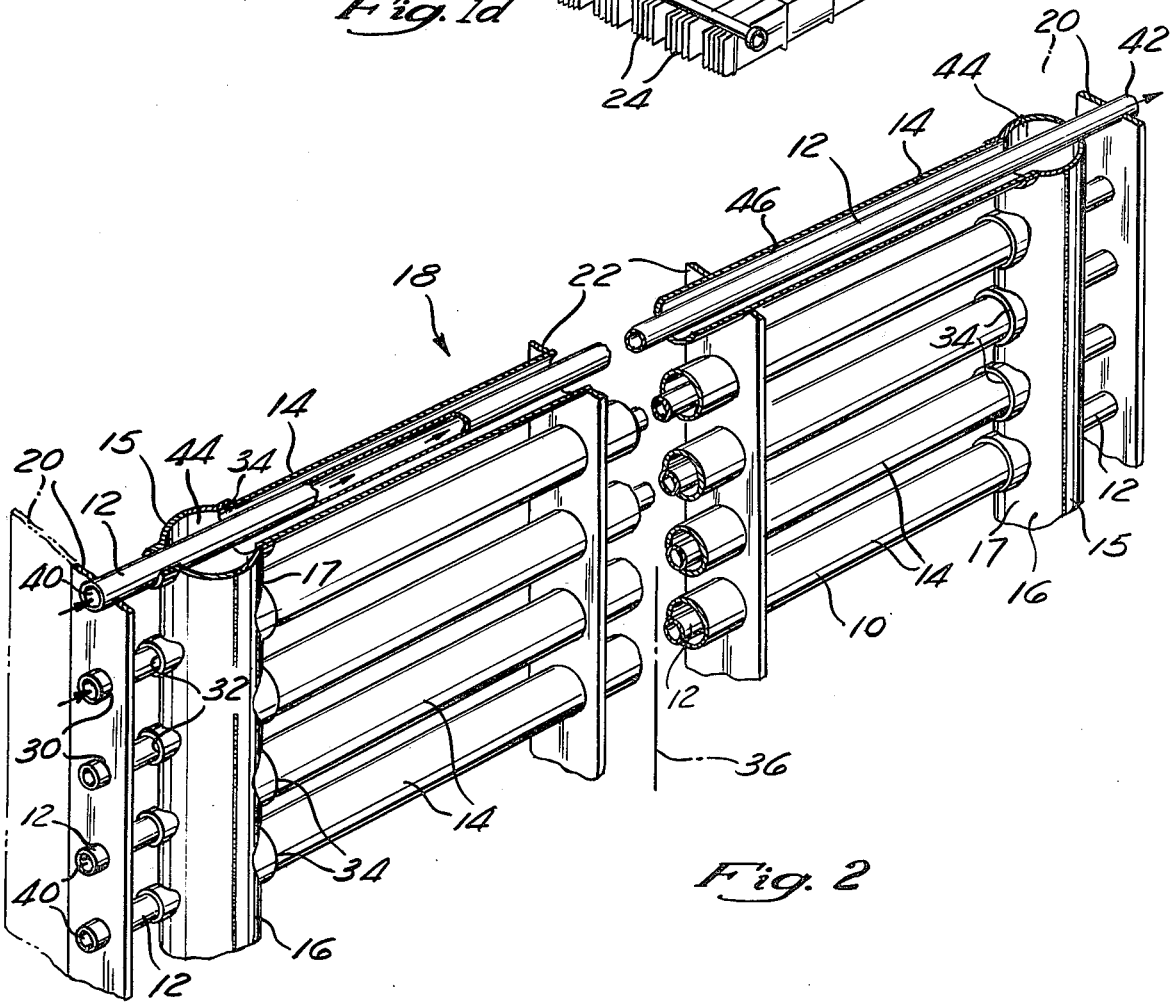
Fig. 2

Fig. 3
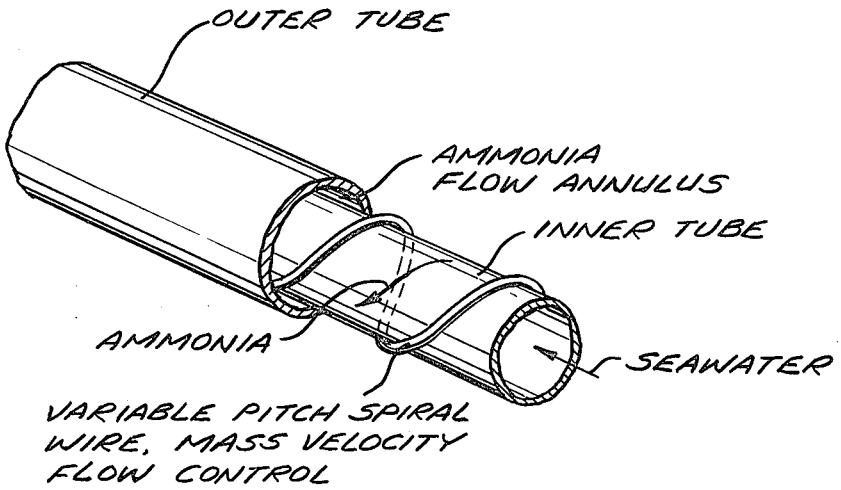
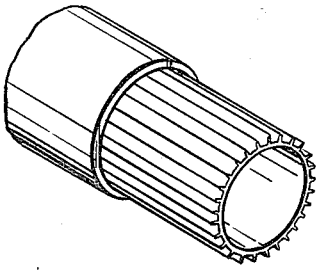
Fig. 4a
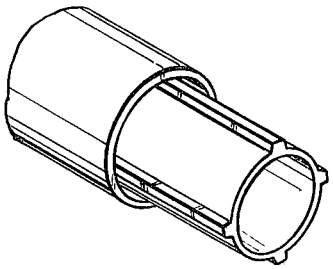
Fig. 4b
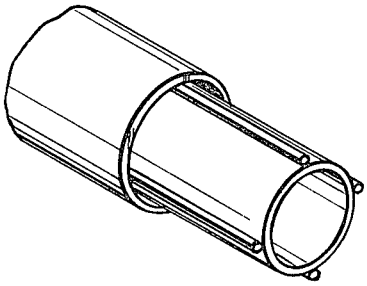
Fig. 4c
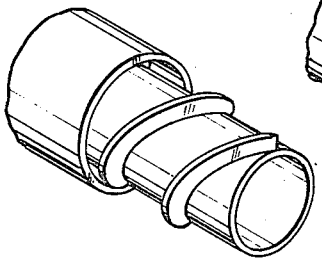
Fig. 4d
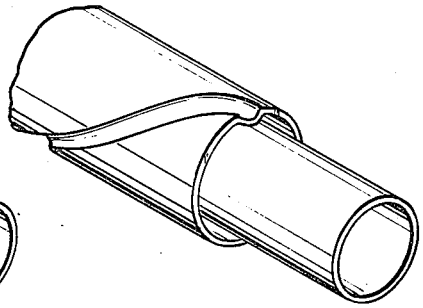
Fig. 4e
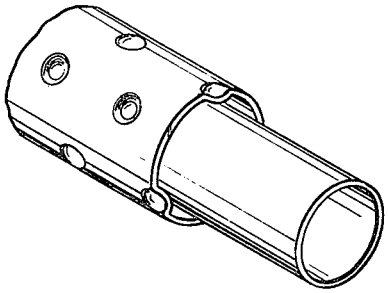
Fig. 4f

SINGLE ELEMENT TUBE ROW HEAT EXCHANGER

BACKGROUND OF THE INVENTION

1. Field of the Invention

This invention pertains to heat exchangers and, more specifically, to modular shelless tube-in-tube heat exchangers.

2. Description of the Prior Art

Conventional tube type heat exchangers are generally made by joining multi-tube bundles with end tube sheets. The number of tubes can often reach thousands in one bundle or module. A casing is placed around the tubes and is joined to the tube sheets at each end. In operation, a first fluid generally passes through the tubes while a second heat exchange fluid usually passes randomly across the tubes thereby effecting heat transfer across the tube wall.

Major fabrication problems exist in assembling these multi-tube bundles including joining, misalignments, and tolerance variations. Tube bundles are difficult to assemble while leak-checking and repair of inner tubes become formidable and costly problems.

SUMMARY OF THE INVENTION

Accordingly, there is provided by the present invention a tube-in-tube modular heat exchanger which comprises a plurality of tube-in-tube heat exchanger elements combined to form a single element tube row. The single element tube row module is then joined by manifolds and headers to form the desired heat exchanger.

OBJECTS OF THE INVENTION

Therefore, it is an object of the present invention to provide a modular heat exchanger.

A further object of the present invention is to provide a heat exchanger which can be leak-checked as it is being constructed.

Another object of the present invention is to provide a method of making modular heat exchangers.

Still another object of the present invention is to provide a heat exchanger having low maintenance costs.

Yet another object of the present invention is to provide a heat exchanger made up of a single element tube row.

Another object of the present invention is to provide high heat transfer efficiency with a finned tube-in-tube design.

Yet another object of the present invention is to provide a lightweight aerospace manifolding approach to a tube-in-tube heat exchanger.

Still another object of the present invention is to provide 100 percent heat transfer scaling factor from sub element.

Other objects, advantages and novel features of the present invention will become apparent from the following detailed description of the invention when considered in conjunction with the accompanying drawings.

BRIEF DESCRIPTION OF THE DRAWINGS

FIG. 1*a* is a schematic representation of the concentric tube element.

FIG. 1*b* is a schematic representation of a single element tube row.

FIG. 1*c* is a schematic representation of a heat exchanger module made from a plurality of single element tube rows.

FIG. 1*d* is a schematic representation of a heat exchanger comprising a plurality of heat exchanger modules.

FIG. 2 is a schematic representation of a preferred embodiment of the single element tube row heat exchanger.

FIG. 3 is a schematic representation of fluid flow through a single tube-in-tube element.

FIG. 4*a* is a schematic representation of one embodiment of a single tube-in-tube element.

FIG. 4*b* is a schematic representation of one embodiment of a single tube-in-tube element.

FIG. 4*c* is a schematic representation of one embodiment of a single tube-in-tube element.

FIG. 4*d* is a schematic representation of one embodiment of a single tube-in-tube element.

FIG. 4*e* is a schematic representation of one embodiment of a single tube-in-tube element.

FIG. 4*f* is a schematic representation of one embodiment of a single tube-in-tube element.

DESCRIPTION OF THE PREFERRED EMBODIMENTS

Figure 5:
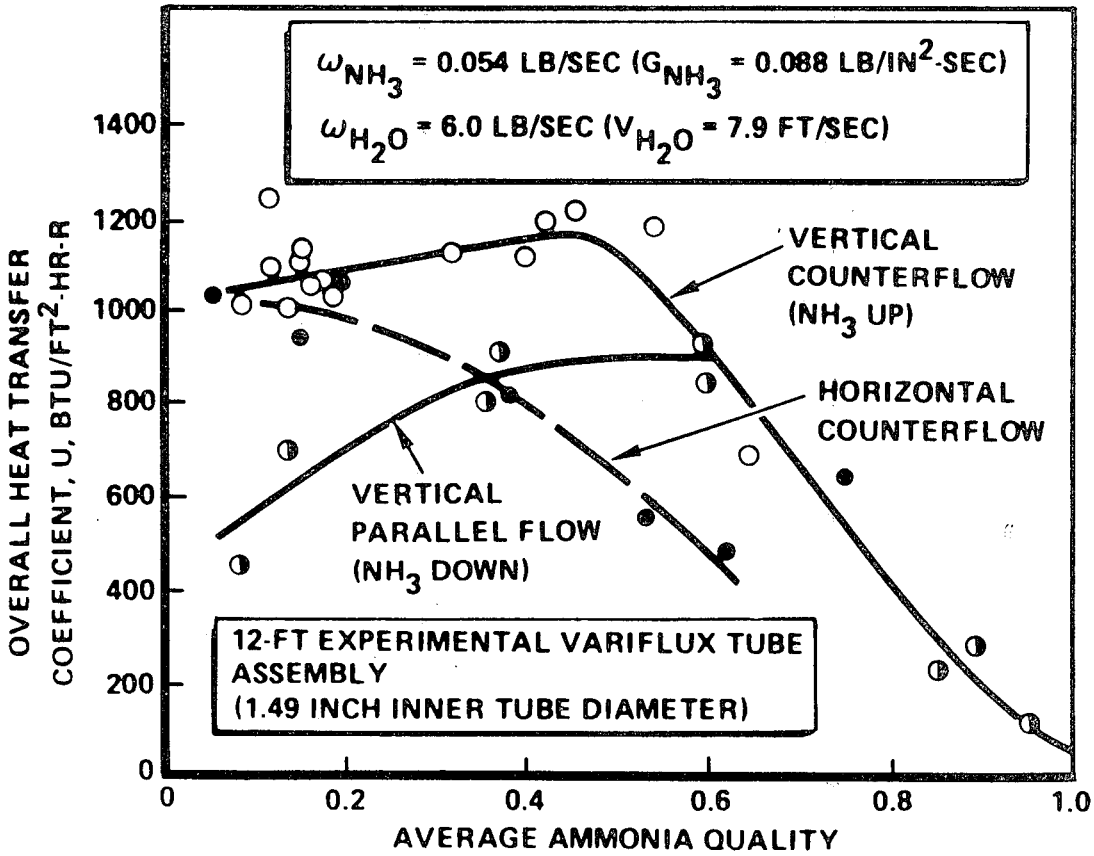
FIG. 5 is a graphical representation of experimental test results on a 12 foot 1.49 inch inner tube diameter tube-in-tube heat exchanger element.

Referring now to the present invention wherein like numerals represent like elements throughout, there is provided a modular tube-in-tube heat exchanger and method of making a modular heat exchanger.

Referring now to FIGS. 1*a*–1*d*, there is shown a heat exchanger element generally designated 10 comprising inner tube 12, outer concentric tube 14, and a flexible arcuate manifolding means 16. Depending on the individual design parameters, any number of elements 10 can be stacked in a single tube row generally designated 18 and then joined, as shown in FIG. 1*b*, by tube sheets 20 and tube frames 22. The number of tube frames needed must be determined on a case-by-case basis since it will depend upon parameters such as tube thickness, element length and internal pressure. A plurality of single tube rows 18 can then be joined to form a heat exchanger module generally designated 24. Headers 26, 26 are then joined to a flexible arcuate manifolding means 16 to provide a means for conveying a heat exchange fluid from a source, through the element 10 and to some external holding area.

FIG. 2 is a preferred embodiment of the single element tube row heat exchanger module 18. The single tube row, generally designated 18, is comprised of inner tubes 12, outer tubes 14, tube sheets 20, a flexible arcuate manifold 16 which is made up of upper manifold sheets 15 and lower manifold sheets 17, and tube frames 22. Tube 12 is joined to tube sheet 20 at joint 30, and to manifold sheet 15 at joint 32. Tube 14 is joined to manifold sheet 17 at joint 34. It should be noted that manifold sheet 15 can serve a double function and also act as tube sheet 20 thereby eliminating the need for tube sheet 20 and the extension of inner tube 12 from the manifold sheet 15 to tube sheet 20.

The structure is symmetrical about plane 36, equidistant from each end, thereby having a similar tube sheet 20 and flexible arcuate manifold 16 at each end. A row of single tubes 10 is joined to the tube sheet edges 38, the joints are easily leak-checked and repaired. When the individual tube rows are acceptance-tested, they are then joined together at the tube sheet edges to form the desired module size. If leaks or tube failures occur during operation, the tube row modular unit can be readily broken down to the elemental tube row where repair or replacement of particular tubes can unobstructively take place. In addition, this method of modularization prevents one fluid from leaking into the second fluid.

The element structure is preferably a thin wall sheet metal structure which lends itself to low-cost stamping, forming, and welding fabrication techniques. Note that no outer casing is required to contain the outer fluid as in conventional types of heat exchangers since this function is performed by the integral flexible arcuate manifolds 16.

The flexibility of the sheet metal tube sheets and manifolds minimizes joint stresses caused by differential thermal growths of the tubes.

In the preferred operating sequence, a first liquid or gaseous heat transfer fluid flows into inner tubes 12 through inlets 40, along the interior length of inner tube 12 and exits from ports 42. Countercurrently, a second liquid or gaseous heat transfer fluid flows into flexible arcuate manifold 16' through inlet port 44 along gap 46 and exits from outlet 48. It should be noted that although countercurrent flow is preferred, flow could also be parallel.

The principal advantage of the tube-in-tube concept as applied to Ocean Thermal Energy Conversion or other use is that working fluid such as the preferred $NH_3$ can be closely confined in an annular space FIGS. 4*a*–4*f* to promote a high heat transfer rate situation FIG. 5. This is significantly different from vertical or horizontal designs for tube in shell type exchangers where liquid or vapor is randomly brought into contact with the heat exchange surface. This is especially true for designs where the inner tube external and/or internal surfaces are flutted or finned 50. As a consequence, the intensity of the evaporating or condensing fluid in confinement plus the forced convection influence, in the annular space together with the equal flow distribution per tube element, results in up to 2 to 3 times the normal heat transfer rates associated with a normal tube in shell design FIG. 5.

Consequently, development of the design concept can proceed from a basic building block element 10 of a single tube assembly which can be carefully engineered and tested, and then manufactured/assembled into a single tube row 18. In the tube row every element works equally well. These tube rows are assembled into an entire heat exchanger unit 24 composed of welded trays of these tube rows. A considerable advantage on repair and on-site assembly of huge design configurations 30×50 feet in size.

Obviously, many modifications and variations of the present invention are possible in light of the above teachings. It is, therefore, to be understood that, within the scope of the appended claims, the invention may be practiced otherwise than as specifically described.

What is claimed as new and is desired to be secured by Letters Patent of the United States is:

1. A tube-in-tube heat exchanger having the capability of being modularized, which comprises:

at least one inner tube having forward and aft ends for carrying a first heat exchanger fluid;

an outer tube having forward and aft ends, concentric with each inner tube, for carrying a second heat exchanger fluid;

means for manifolding said inner tubes; and a flexible arcuate thin wall manifold for said outer tubes, wherein said manifold further compresses an integral flange for each inner and outer tube and wherein said flange defines ports for said inner and said outer tubes wherein said integral flanges extend beyond the circumference of said manifold so as to provide means for joining said tubes to said manifold, and wherein said joint is capable of withstanding the thermal stresses experienced by said heat exchanger.

2. The heat exchanger of claim 1 having the capability of being modularized, further comprises at least one tube frame for providing longitudinal support and alignment to said concentric tubes.

3. The heat exchanger of claim 1 wherein there is a plurality of tube-in-tube elements arranged to form a single element tube row.

4. The heat exchanger of claim 1 further comprises a header for each row of manifold tubes.

5. The heat exchanger of claim 1 further comprises forward and aft tube sheets connected respectively to said forward and aft ends of said inner tubes.

6. The heat exchanger of claim 1 wherein said inner tube further comprises at least one external fin.

7. The heat exchanger of claim 6 wherein said external fins are integral.

8. The heat exchanger of claim 6 wherein said inner tube further comprises at least one interior fin.

9. The heat exchanger of claim 8 wherein some interior fins are integral.

10. A modular tube-in-tube heat exchanger, which comprises:

a plurality of inner tubes having forward and aft ends, arranged in a radially-oriented line for carrying a first heat exchange fluid;

an outer tube having forward and aft ends, concentric with each of said inner tubes for carrying a second heat exchange fluid;

a forward tube sheet connected to said forward ends of said inner tubes;

an aft tube sheet connected to said aft ends of said inner tubes;

an axially positioned inlet and outlet for each of said inner tubes; and flexible arcuate manifold means transversely connected through integral flanges one each to said forward and said aft ends of said outer and said inner concentric tubes.

* * * * *